US006568130B1

(12) United States Patent
Hörmann

(10) Patent No.: US 6,568,130 B1
(45) Date of Patent: May 27, 2003

(54) SAFETY CONTACT RAIL INCLUDING A FREELY MOVING CONTACT ELEMENT AND HOLLOW PROFILE SITUATED THEREABOUT

(75) Inventor: Michael Hörmann, Halle (DE)

(73) Assignee: Marantec Antriebs-und Steuerungstechnik GmbH & Co. KG, Marienfeld (DE)

( * ) Notice: Subject to any disclaimer, the term of this patent is extended or adjusted under 35 U.S.C. 154(b) by 0 days.

(21) Appl. No.: 09/663,908

(22) Filed: Sep. 18, 2000

(30) Foreign Application Priority Data

Sep. 17, 1999 (DE) ..... 299 16 409 U

(51) Int. Cl.[7] ..... H01H 1/14
(52) U.S. Cl. ..... 49/27; 49/28
(58) Field of Search ..... 49/26, 27, 28; 200/61.43

(56) References Cited

U.S. PATENT DOCUMENTS

| | | | | | |
|---|---|---|---|---|---|
| 1,634,665 | A | * | 7/1927 | Hedley et al. | 200/61.43 |
| 2,135,131 | A | * | 11/1938 | Bassett | 200/61.43 |
| 3,710,050 | A | * | 1/1973 | Richards | 200/61.43 |
| 3,793,772 | A | * | 2/1974 | Kouth | 49/28 |
| 3,849,614 | A | * | 11/1974 | Connery | 200/61.41 |
| 4,051,336 | A | * | 9/1977 | Miller | 200/61.43 |
| 4,301,621 | A | * | 11/1981 | Houweling | 49/27 |
| 5,072,080 | A | * | 12/1991 | Beckhausen | 200/61.43 |
| 5,157,230 | A | * | 10/1992 | Blubaugh | 200/61.43 |
| 5,166,586 | A | * | 11/1992 | Yaguchi | 318/434 |
| 5,296,658 | A | * | 3/1994 | Kramer et al. | 200/61.43 |
| 5,327,680 | A | * | 7/1994 | Miller | 49/27 |
| 5,399,851 | A | * | 3/1995 | Strand | 250/222.1 |
| 5,566,504 | A | * | 10/1996 | Pitel | 49/28 |
| 5,964,058 | A | * | 10/1999 | Richardson | 49/27 |

FOREIGN PATENT DOCUMENTS

| | | | | |
|---|---|---|---|---|
| DE | 3304400 | | 8/1984 | |
| DE | 3921533 | | 1/1991 | |
| DE | 4329535 | | 2/1995 | |
| DE | 4328167 | | 3/1995 | |
| DE | 19711600 | | 9/1998 | |
| EP | 353332 | * | 2/1990 | 49/26 |
| EP | 0380398 | | 8/1990 | |
| EP | 405351 | * | 1/1991 | 49/26 |
| EP | 539887 | * | 5/1993 | 49/27 |
| EP | 0638701 | | 2/1995 | |
| EP | 0916795 | | 5/1999 | |
| GB | 178398 | * | 7/1922 | 49/27 |

* cited by examiner

*Primary Examiner*—Gregory J. Strimbu
(74) *Attorney, Agent, or Firm*—Dilworth & Barrese LLP.

(57) ABSTRACT

A safety contact rail for a movable closing mechanism includes a hollow profile having a deformable region, an electrically-conductive area positioned along an inner surface of the hollow profile and a contact element that is positioned therein to be freely movable with respect to the hollow profile and having a conductive area over at least a portion of its surface which is arranged to contact the hollow profile conductive area upon deformation of the hollow profile.

12 Claims, 3 Drawing Sheets

SAFETY CONTACT RAIL INCLUDING A FREELY MOVING CONTACT ELEMENT AND HOLLOW PROFILE SITUATED THEREABOUT

BACKGROUND OF THE INVENTION

This invention relates to a safety contact rail, particularly for movable units such as movable closing mechanisms.

From DE 33 04 400 C3, a safety contact rail is known for power-actuated units, such as roller gates, roller grills, etc., with a hollow elastic profile mounted on the movable portion of the unit, which hollow elastic profile is formed as a single-chamber profile. Inside the hollow elastic profile, an edge-like rib is provided that is formed in one piece with the hollow elastic profile and is also produced of rubber. The surface of the edge-like rib is formed as an electrically-conductive contact surface, where the edge-like rib is also provided with an electrically-conductive contact surface on the inside of the hollow elastic profile so that in the case of deformation of the safety contact rail, as occurs, for example, upon encountering an obstacle in the closing area of a gate, the hollow elastic profile is deformed and, with its conductive contact surface applied to the inside, is brought into contact with the conductive contact surface of the edge-like rib. A circuit is thus completed and a signal for controlling the drive mechanism is emitted so that, for example, the closing motion of the gate is stopped when it encounters an obstacle.

SUMMARY OF THE INVENTION

This invention relates to a safety contact rail as well as a closing mechanism that are suitable for a broad range of applications. In particular, a safety contact rail is proposed together with a closing mechanism with which the response can be adjusted in accordance with current requirements.

The safety contact rail for a movable unit, such as a movable closing mechanism pursuant to the invention, has a hollow profile with a deformable section, preferably made of an elastic material, which can be applied, for example, to a roller gate or roller grille. The hollow profile here also can run along the entire closing edge of the closing mechanism. However, it is also possible to provide a hollow profile at only certain locations along the closing edge. On the inside of the hollow profile, at least one electrically-conductive area is provided that can be produced, for example, by coating the elastic material with conductive materials, such as graphite. It is also possible to apply or connect conductive elements, such as thin metal strips, on the corresponding surface.

In the hollow profile, there is at least one freely-movable contact element that is preferably formed without a positive lock with the hollow profile. Here, the contact element in its resting state is in contact with a surface area on the inside of the hollow profile and preferably has a conductive area on its surface that, upon deformation of the hollow profile due to external forces such as an obstacle impeding a closing motion, can be brought into contact with the electrically-conductive area on the inside of the hollow profile to close a circuit and thus transmit control signals, for example, to the drive of the closing mechanism. The deformation of the elastic area of the hollow profile leads to a reduction in the internal space, whereby the internal contact element is pressed against a conductive surface upon sufficient deformation of the hollow profile, in order to close, for example, an electric contact.

The contact element, lying in a freely movable manner inside the hollow profile, can, for example, be thrust easily laterally or removed again with a safety contact rail running along the entire closing edge, whereby the desired response of the safety contact rail can be achieved by use of contact elements of different sizes or shapes. If for example round contact elements are used, a contact element with a large diameter comes into contact with the respective conductive area of the contact element and the hollow profile upon only a slight deformation, increasing the responsiveness. Contact elements with relatively small diameters, in contrast to this, first come into contact with the conductive area inside the hollow profile only after a greater deformation of the hollow profile so that the responsiveness is reduced.

Making the entire surface of the contact element conductive is preferred; in this manner, a conductive area always points toward a likewise conductive area of the hollow profile upon rotation or displacement of the contact element inside the hollow profile, so that both conductive areas come into contact upon deformation of the hollow profile in order to create an electric contact.

The inside of the hollow profile is advantageously provided on its top (in the installed position) side with a conductive area so that the contact area coming into contact, due to gravity, with the bottom inside of the hollow profile does not come into contact with the conductive area due to a lateral motion, but rather only due to a force working in the direction opposite to that of the closing, which leads to a deformation of the hollow profile in the direction of its top side. However, it is also possible to create other areas, for example, lateral areas inside the hollow profile that are conductive, to achieve the desired response, for example, also in the case of lateral or oblique deformations.

The contact element is preferably approximately round so that the rotation of the contact element has no effect on the response of the safety contact rail. Other forms, however, can also be selected for the contact element, such as a triangular or polygonal cross-section, or a star, to achieve desired responses. Furthermore, it is possible to create the contact element along the safety contact rail in different shapes, in order to achieve greater responsiveness, for instance, in the middle of a roller gate than at the edges.

The contact element can be formed as a hollow profile, e.g., in the form of a tube. It is also possible to form the contact element as a solid without a hollow profile, e.g., as a rod element.

The diameter of the contact element or the maximum distance in cross-section between two points lying on the circumference of the contact element is advantageously in the range of 0.1 to 0.9 times the minimum interior diameter of the hollow profile. Here, the responsiveness of the safety contact rail can be varied by adjusting the degree of deformation necessary before a conductive area of the contact element contacts a conductive area of the inside of the hollow profile as a result of the size of the contact element. Here, the fact that the absolute size of the contact element or hollow profile plays an important role in the response of the safety contact rail, and is preferably in the range of a few mm to cm, must be taken into account.

Making the hollow profile and/or the contact element out of rubber is advantageous. However, it is not necessary to make the entire hollow profile of elastic material or rubber. It is possible to make only the area of the hollow profile on the bottom (in the installed state) of the area guiding, for example, a roller gate, of elastic material so that it can be deformed by an obstacle. The remainder of the hollow profile can, for example, be made of plastic or metal. The contact element can also be made completely of rubber. As an alternative, it is also possible to use a metal rod or metal tube or another object with at least one electrically-conductive surface area as the contact element.

Advantageously, a weight element can be integrated to cause an asymmetric weight distribution in the contact element, to establish a certain defined rest position for the contact element with the help of gravity. For instance, a contact element made completely of rubber can have an inserted metal rod in its outer area that, with a suitably shaped contact element, can ensure that the area provided with the metal rod is at the bottom, due to gravity, so that, for example, a peg projecting from the contact element points upward in the rest position.

Providing both the contact element and the hollow profile with a connection for an electric line is particularly preferred, so that, for example, an electric signal can be transmitted to a control for the drive of the closing mechanism, if the conductive area of the contact element and the hollow profile come into contact and a circuit is thus completed.

Sealing the hollow profile air-tight is preferred so that it can be connected with a pressure-sensitive switch, where a deformation of the hollow profile triggers the pressure-sensitive switch and emits a suitable control or stop signal to the drive of the closing mechanism.

Providing an active component in the safety contact rail is advantageous; it is connected with at least one conductive area of the hollow profile and at least one conductive area of the contact element so that a voltage applied between these conductive areas can be influenced by this active electric component, such as a quartz resonator or similar. Thus, for example, with the assistance of a quartz resonator or a suitable controlled transistor circuit, certain resonances can be modulated to the applied voltages, so that if the conductive area makes contact, this resonance pattern can be altered—or even completely suppressed—so that by means of such a change in the signal form, the presence of a obstacle causing a deformation can be observed. Thus, an obstacle can be reliably detected, and by means of a suitable control circuit, the drive of the closing mechanism can be stopped. However, the safety contact rail can also be operated without such an active component.

The invention further relates to a contact element for a safety contact rail, formed of an elastic material and equipped at its outside edges with at least one conductive area.

Furthermore, the invention relates to a closing mechanism with a safety contact rail as described above and a drive for the closing mechanism that is controlled by a control that is connected electrically to the safety contact rail.

BRIEF DESCRIPTION OF THE DRAWINGS

The invention is described based on the following two preferred embodiments. They show.

DESCRIPTION OF THE PREFERRED EMBODIMENTS

Figure 1:
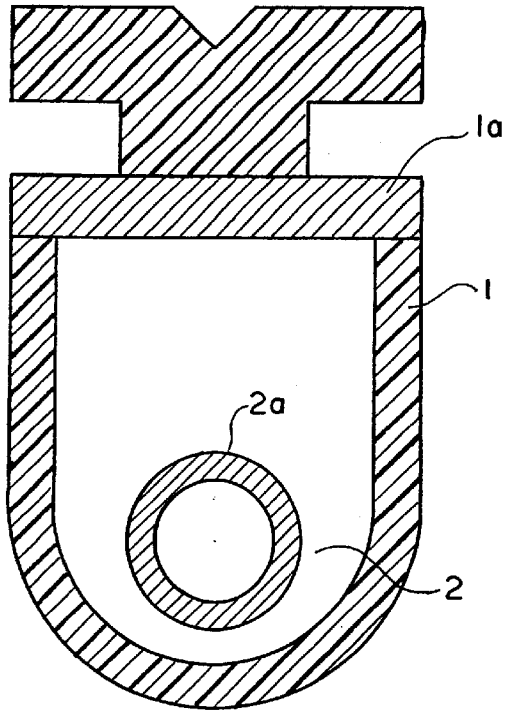
FIG. 1 a first embodiment of a safety contact rail in cross-section.

FIG. 1 shows a safety contact rail made of rubber with a hollow profile 1, in which a tubular contact element 2, made of rubber, is placed. The hollow profile 1 can be fastened at its upper end to the closing edge of a gate and has, at its upper side, a conductive area 1*a* inside it, as shown in FIG. 1 by the hatching. The contact element 2 also has a conductive area 2*a* over its entire circumference. If the safety contact rail shown in FIG. 1 encounters an obstacle during a downward, closing motion, the hollow profile 1 is gradually deformed from the bottom, whereby the contact element 2 is moved in a direction toward the upper conductive area 1*a* of the hollow profile 1. As soon as the conductive areas 1*a* and 2*a* of the hollow profile 1 and contact element 2 come into contact, an electric contact is created so that the drive of the closing mechanism can be stopped.

Figure 2:
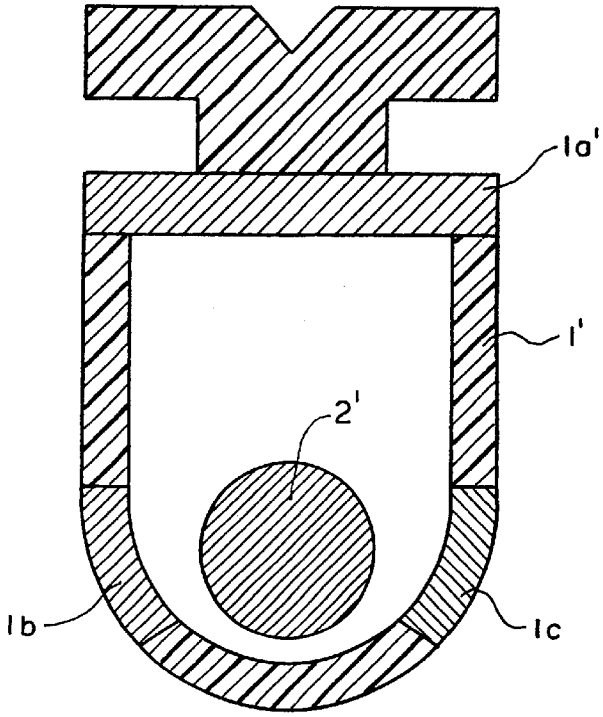
FIG. 2 a second embodiment of a safety contact rail in cross-section.

FIG. 2 shows a cross-section of a second embodiment of the safety contact rail according to the invention. In contrast to FIG. 1, the contact element 2' is designed as a solid rail, e.g., a solid rod that lies in the hollow profile 1'. In addition to the conductive area 1*a*' in the upper portion of the safety rail, additional conductive areas 1*b*, 1*c* are provided at the sides of the hollow profile 1' so that even lateral deformations of the hollow profile 1 lead to an electric contact between a conductive area 1*b* or 1*c* and the electrically-conductive area 2*a*' of the contact rail 2', so that even in the case of an oblique deformation caused by an obstacle, an electric signal to stop the closing motion can be produced rapidly. The inner surface of the hollow profile 1' including electrically non-conductive areas disposed between the electrically conductive areas.

Figure 3:
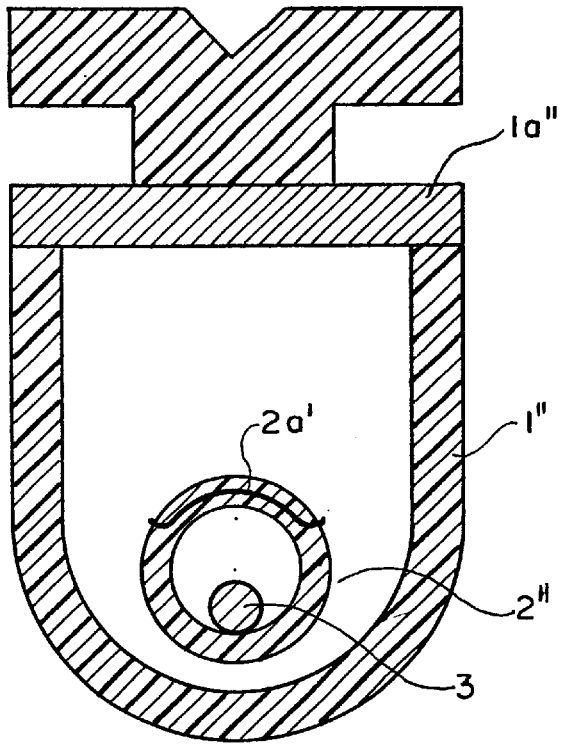
FIG. 3 illustrates the contact element provided with a weight element to produce a defined undeformed rest position with respect to the outer hollow profile.
Figure 5:
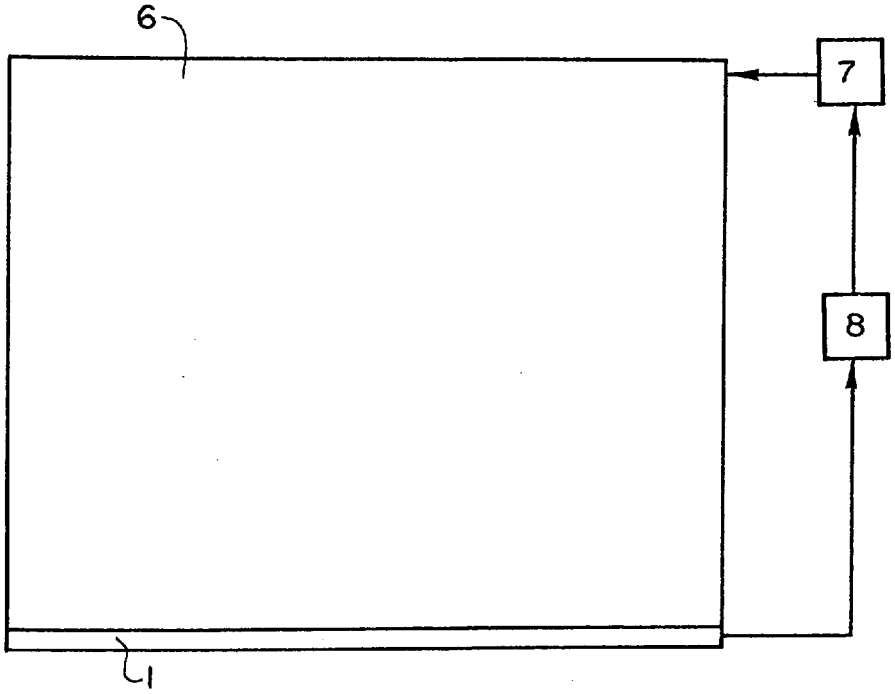
FIG. 5 illustrates a closing mechanism utilizing the inventive safety contact rail and comprising a drive with a closing mechanism and a control for the drive that is electrically connected with the safety contact rail.
Figure 4:
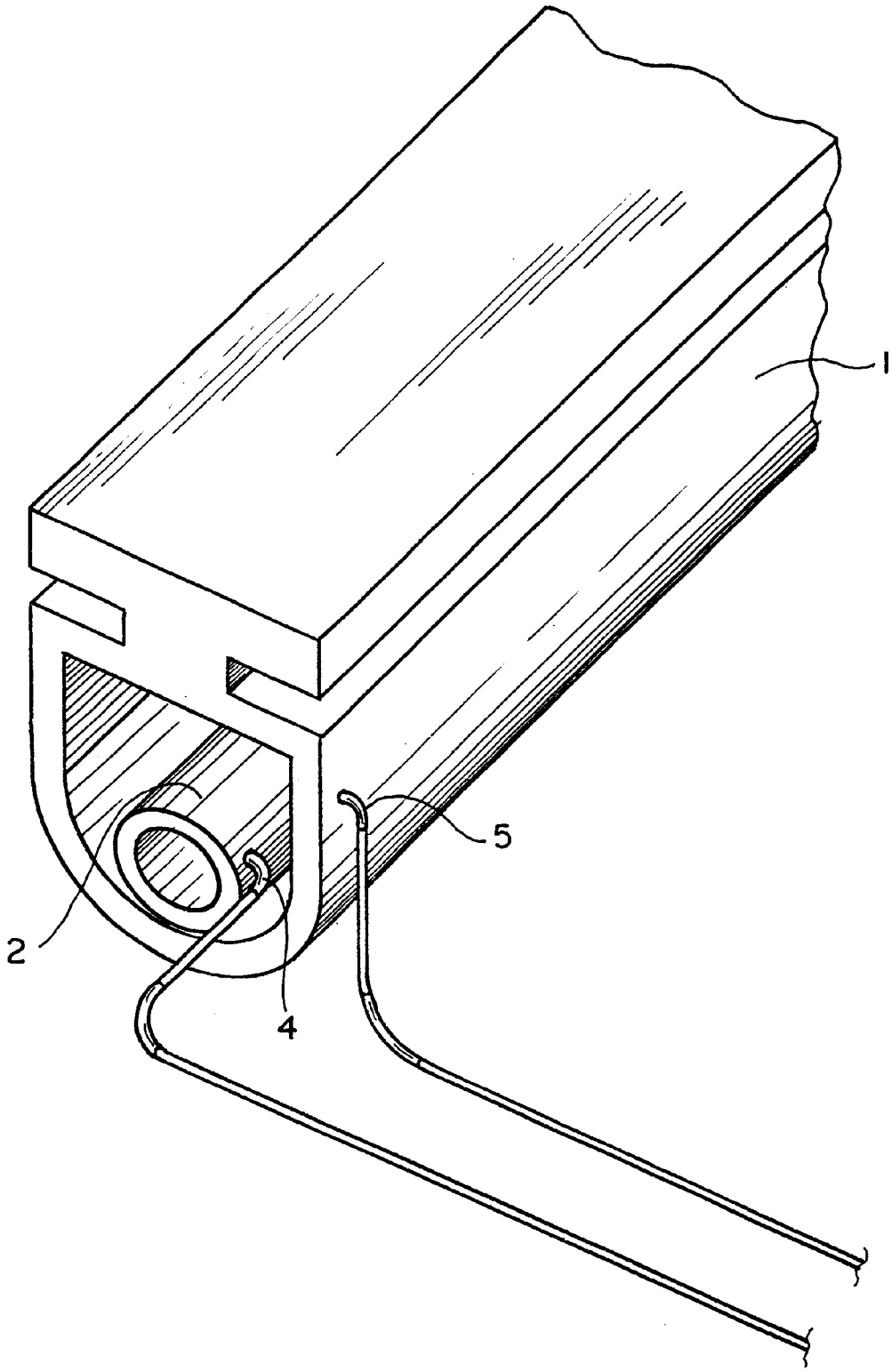
FIG. 4 illustrates electrical connections for the contact element and hollow profile.

FIG. 3 shows a cross sectional view of the safety contact rail wherein the hollow profile 1" includes a contact element 2" having a weight element 3 and an electrically conductive area 2*a*' for contacting the electrically conductive area 1*a*" of the hollow profile 1". FIG. 4 shows the contact element electrical connection 4 with a line and the hollow profile electrical connection 5 with a line. Finally, FIG. 5 shows the hollow profile 1 disposed on a roller gate 6 wherein the roller gate 6 is driven by a drive 7 the operation of which is controlled by a control 8.

What is claimed is:

1. A safety contact rail for a movable closing mechanism comprising:

(a) a hollow profile (1) provided with an inner surface and a deformable area;

(b) the hollow profile (1) provided at an upper part thereof with a structure for fastening to a support;

(c) a first electrically conductive area being positioned along the inner surface at the upper part of the hollow profile (1) adjacent said fastening structure, and additional electrically conductive areas (1*b* and 1*c*) being provided along lateral sides of the hollow profile (1) inner surface the inner surface of the hollow profile including electrically non-conductive areas disposed between said electrically conductive areas;

(d) a contact element (2) formed as a rail, positioned within the hollow profile (1) such that the contact element (2) is free floating within the hollow profile (1), and the contact element (2) having an electrically conductive area (2*a*) over at least a portion of an outer surface thereof, wherein, when the safety contact rail moves against an obstacle, the resulting deformation of the hollow profile (1) results in an electrical connection between at least one of the electrically conductive areas (1*a*, 1*b*, 1*c*) positioned upon the inner surface of the hollow profile (1) and the electrically conductive area (2*a*) on the outer surface of the contact element (2), and lateral deformations of the hollow profile (1) result in an electrical connection between at least one of the electrically conductive areas provided along the lateral sides (1*b*, 1*c*) of the hollow profile (1) and the electrically conductive area (2*a*) of the contact element (2), such that upon oblique deformations of the hollow profile (1) caused by the obstacle, an electric signal for stopping a closing motion of the closing mechanism can be rapidly produced.

2. Safety contact rail according to claim 1, wherein the entire outer surface of the contact element (2) is conductive.

3. Safety contact rail according to claim 1, wherein the contact element (2) is hollow.

4. Safety contact rail according to claim 1, wherein at least one said electrically conductive area of one of said hollow profile and said contact element is connected with a line.

5. Safety contact rail according to claim 1, wherein the hollow profile (1) is sealed air-tight.

6. Safety contact rail according to claim 1, wherein the hollow profile (1) and contact element (2) are positioned such that a maximum distance between two points lying on a circumference of the contact element (2) is 0.1 to 0.9 times as large as a minimum interior diameter of the hollow profile (1).

7. Safety contact rail according to claim 1, wherein the electrically conductive areas (1*a*, 1*b*, 1*c*) of the hollow profile (1) and the electrically conductive area (2*a*) of the contact element (2) are coupled with an active electrical component.

8. Safety contact rail according to claim 1, wherein at least one of the hollow profile (1) and contact element (2) is made of rubber.

9. Safety contact rail according to claim 1, wherein the contact element (2) has a circular cross-section.

10. Safety contact rail according to claim 1, wherein a weight element is integrated within the contact element (2) to produce a defined rest position of the contact element with respect to the hollow profile (1').

11. Safety contact rail according to claim 1, wherein the contact element (2) is a solid rail.

12. A closing mechanism with:

(a) a safety contact rail according to claim 1;

(b) a drive for the closing mechanism; and (c) a control for the drive that is electrically connected with the safety contact rail.

* * * * *